US005332902A

United States Patent [19]

Bellis

[11] Patent Number: 5,332,902

[45] Date of Patent: Jul. 26, 1994

[54] MODULE DETECTION UNIT INCLUDING INFRARED DETECTORS

[76] Inventor: Freddy L. Bellis, Noord 27, NL-1741 BA Schagen, Netherlands

[21] Appl. No.: 932,269

[22] Filed: Aug. 19, 1992

[30] Foreign Application Priority Data

Aug. 23, 1991 [NL] Netherlands ..... 9101431

[51] Int. Cl.[5] ..... G08B 13/18

[52] U.S. Cl. ..... 250/349; 250/342

[58] Field of Search ..... 250/349, 342

[56] References Cited

U.S. PATENT DOCUMENTS

| | | | |
|---|---|---|---|
| 4,220,415 | 9/1980 | Staab et al. | 356/246 |
| 4,437,004 | 3/1984 | Passaro et al. | 250/343 |
| 4,486,661 | 12/1984 | Guscott et al. | 250/353 |
| 4,746,906 | 5/1988 | Lederer | 250/353 |
| 4,847,485 | 7/1989 | Koelsch | 250/342 |
| 4,912,748 | 3/1990 | Horii et al. | 250/342 |
| 5,026,990 | 6/1991 | Marman et al. | 250/342 |

FOREIGN PATENT DOCUMENTS

| | | | |
|---|---|---|---|
| 0069782 | 1/1983 | European Pat. Off. . | |
| 323621 | 12/1989 | European Pat. Off. | 250/342 |
| 259219 | 10/1989 | Japan | 250/342 |

*Primary Examiner*—Carolyn E. Fields
*Attorney, Agent, or Firm*—Bachman & LaPointe

[57] ABSTRACT

A detection unit comprises a support element and at least one module connectable to the support element, each module comprising a housing and an infrared detector fitted therein. When connected each module has a defined circumferential position relative to the support element. Preferably, the detection unit is designed for fitting three modules which circumferentially enclose the support element, as well as a further module.

14 Claims, 6 Drawing Sheets

MODULE DETECTION UNIT INCLUDING INFRARED DETECTORS

BACKGROUND OF THE INVENTION

The present invention relates to a detection unit, comprising a support element and at least one module connectable to the support element, each module comprising a housing and an infrared detector fitted therein. Such a detection unit is known from the European patent application EP-A- 0 323 621.

In the case of the detection units known in practice, which are used, in particular, in security installations, in general one or two infrared detectors are fitted in a housing. The detection unit is placed in a space that is to be protected, in such a way that the detection range of these infrared detectors will cover part of the space to be protected. Infrared-radiation, which may for example originate from persons present in the space, is detected by a detector if the radiation source (person) is within the detection range of the detector. To protect the whole space it is generally necessary to place several detector units within the space, since only then will the whole space be covered by the detection units.

For the fitting of detection units in different positions within the space, for example in several corners of this space, different detection units are often required. For different locations, detection units with an adjusted detection range (angle coverage) will usually be required. If the unit is placed in the corner of the space, a detection range of, for example, 90° will be required, while for positioning against a plain wall a detection range of 180° will be desirable. Thus, different versions of the detection units have to be produced for different applications. This increases the cost price of such detection units.

The detection unit known from the above-mentioned European patent application is provided with modules, which are connected to the common support elements by means of hinges. These hinges provide two axes of rotation, thus making it possible to vary the orientation of the modules. Although such an arrangement is flexible, due to this largely arbitrary directing of the modules the unit provides no spatial information regarding a detection, i.e. the unit is not possible to determine by means of the detection signals produced by the modules in which part of a space a certain radiation source (e.g. an intruder) is situated. In order to detect an intruder who is situated underneath this known detection unit it is possible to point one of the modules downwards to a certain extent, that as any detector can be bent downwards, a "downward" detection signal cannot be distinguished from any other detection signal. Thus it is not clear whether a detection has been made in the "downward" range or in one of the "horizontal" detection ranges. Furthermore, it is likely that during use the friction of these hinges will diminish, resulting in unwanted changes in the detection range of this known detection unit due to gravity or vibrations.

SUMMARY OF THE INVENTION

An object of the present invention is to avoid the above-mentioned disadvantages and to provide a detection unit that can be adapted in a simple way to different circumstances and placements. A further object of the present invention is to provide a detection unit that can comprise a sufficient number of detectors to protect the space with a single detection unit. Still a further object of the present invention is to provide a detection unit that allows determination in which part of a space an infrared radiation source (intruder) is located. Yet a further object of the present invention is to provide a detection unit that allows the electronics to be centralized in the support element.

According to the present invention, these and other objects can be met by constructing the detection unit in such a way that when connected each module has a defined position relative to the support element.

The modular construction of the detection unit according to the present invention not only achieves the result that the detection unit can be adapted easily to the user requirements, but also that the unit cost price is relatively low, as each unit can be assembled from a small range of standard modules. Furthermore, mounting the unit in the location to be protected is simplified, because only the support element or a suitable mounting element has to be fixed on a wall or a ceiling or on some other base, after which the modules required can be fitted on the support or mounting element. This, in the case of installation in new buildings, has the important advantage that initially only the relatively cheap mounting element has to be installed in the building, and that after completion of or at least after closing off the building the modules can be fitted. Thus theft of the detector modules during the building phase, i.e. before the security installation of which the detection units are part has been completed, can be prevented.

The adaptation of the detection unit according to the invention to the particular application and to new applications can be simplified further if the detection unit is constructed so that the modules are detachably connected to the support element. Thus for example modules that have been found to be unnecessary can be removed in a simple manner, while defective modules can be replaced with minimum installation costs.

In accordance with the present invention each module has, when connected to the support element, a defined position relative to said support element. In this way there is a fixed relationship between a certain module, or at least the mechanical and electrical contacts for fitting the module, and that part of the space that is covered by its detection range. By means of simple fixed wiring connected to the respective contacts it can therefore be determined in which part of a space a detection is made.

Preferably the detection unit is arranged for fitting the modules around the support element. In this way, a defined circumferential position relative to the support element is achieved for each module fitted. This arrangement provides, e.g. in comparison with an elongated arrangement in which a number of modules is fitted next to each other, a compact construction of the detection unit, while the support element is situated in the center of the modules and the electrical connections are thereby arranged centrally. Furthermore the support element is always placed behind each module, and thus cannot come within the range of the detector and limit the detection range. A further advantage of this construction is that the detection ranges of the separate modules of a unit will hardly overlap at all. Thus optimum use is made of the detection range of the modules, while a single unit may cover an entire space.

In a preferred embodiment the modules when fitted circumferentially enclose the support element, thus providing an optimum detection range as well as a compact, mechanically robust structure in which the support element is largely closed off from external influences. In this way, a good protection of the electrical contacts of both the support element and the modules can be achieved.

It is possible to provide the detection unit according to the invention with one or more modules, the maximum number of modules fitted on a single support element being limited by their relative dimensions. In the case of modules being arranged all around the support element, each module takes up part of the circumference of the support element; if each module for example takes up a quarter of the circumference (90°), obviously a maximum of four modules can be fitted. In the detection unit according to the invention, preferably modules are used with detectors having a detection angle of 140°, i.e. their detection ranges are enclosed by an angle of 140°. By using three such modules, therefore, a detection angle of 360° can be achieved. A preferred embodiment of the invention is therefore constructed such that it is designed for fitting three modules, which essentially enclose the support element. In this way a detection range of 360° around the unit is achieved with a minimum number of modules.

Preferably the modules substantially have the shape of circle sectors, as a result of which the detection unit has minimal external dimensions at the same time as maximum internal dimensions. In addition the round shape is favorable for the placing of focusing means, such as Fresnel lenses in front of the detectors. Compact external dimensions are also achieved for the support element, if this is of cylindrical shape. In addition this cylindrical shape is favorable in combination with modules shaped as circular sectors, since this results in a regular shape of the modules.

The modules each comprise a housing in which a detector is arranged. Such a housing is provided with a window through which infrared light can pass to the detector. Such a window, as well as the detector behind it, may be arranged parallel with the general axis of the unit so as to provide a detection range extending essentially "sideways". For many applications the detection unit is conveniently arranged in such a way that each module is provided with a window which is slanted relative to the longitudinal axis of the support element. When the unit is fixed to a ceiling, a detection range is obtained in this way which extends both sideways and downwards.

While it is possible to mount the modules in different configurations on the support element, a further preferred embodiment of the detection unit according to the invention is arranged for fitting a further module comprising a housing and at least one detector, the further module having a detection range which extends substantially in the axial direction of the support element. In this way a detection range can be achieved that extends both all around and below (or above) the detection unit. Particularly in combination with modules having the shape of circular sectors it is expedient if the further module is essentially disc-shaped.

The connection between the modules and the support element has to be both mechanical and electrical. In the context of a detachable connection, it is important that the connection can be made or indeed broken simply and quickly. For this purpose the detection unit according to the invention may be constructed in such a way that each module is provided with contact pins for electrical and mechanical connection to the support element, and that the support element is provided with terminals fitting the contact pins. In this way the required connections can be achieved simply, while the connection is also detachable. The detection unit may furthermore be constructed in such a way that a module has two contact pins. This provides an electrical and mechanical connection with a minimum number of components. Alternatively, suitable connectors may be used, which may in turn comprise contact pins.

In order to make possible a further adaptation of the detection unit according to the invention to the specific application, this detection unit may be constructed in such a way that the detectors have positions which are adjustable relative to the housing of the modules. In this way it is for example possible to change the position of the detectors relative to the modules so that, if the modules are positioned in one plane, the detection range need not lie exclusively in or near that plane. It should be understood that each module still has a defined position relative to the support element. For the purpose of adjusting the detectors the detection unit can be constructed in such a way that the detectors are connected by pins projecting into the support element which are movable relative to the module housing, and that the modules can be moved relative to the support element by means of an adjustment element fitted on the support element and engaging in the modules in such a way that the position of the detectors is adjusted by the movement. The adjustment element may for example comprise an adjusting knob that can be operated from outside the unit. By adjusting the position of the detectors relative to the lens (or lenses) of the module, the optical axis of the detector/lens combination is adjusted at the same time. In this way it is possible to adjust this optical axis, and thus the detection range of the detector, relative to the module to a certain extent. As such an adjustment is preferably carried out in the longitudinal direction of the support element, the defined position of the modules is not compromised.

In a security system provided with a detection unit according to the invention use can expediently be made of the fact that a detection unit is constructed from several, essentially independent modules. If the module of a particular unit which has detected the presence of a radiation source (person) is registered, the position of that person relative to the detection unit is known. Preferably a security system according to the invention is constructed in such a way that the detection unit is placed centrally in a space. In this context the unit can for example be placed in the middle, or roughly in the middle, of the ceiling of the space. The modules, for example three in number, divide the space into a corresponding number of sectors, thus enabling determination of the sector in which the person is to be found.

The support element of the detection unit according to the invention is preferably characterized by terminals for accepting contact pins of the modules, as well as a mounting element for mounting the support element on a supporting surface. Conveniently, the mounting element is rotatably connected to the support element. Also, the support element can be fitted with electronic circuitry, thus making it possible to use relatively inexpensive modules which themselves contain no electronics. The supporting surface may for example be a wall or a ceiling. The mounting element is preferably constructed in such a way that for placement in a corner it is provided with at least two converging edges, and/or that for placement on a corner it is provided with at least two diverging edges. This achieves the result that the support element and thereby the whole detection unit can easily be aligned when being placed. Thus the unit may be mounted at an angle of 45° relative to the walls, for example, in a (right-angled) corner of two walls, if the converging edges of the support element each form an angle of 45° with, for example, the longitudinal axis of the supporting element.

BRIEF DESCRIPTION OF THE DRAWINGS

The invention will be explained below with reference to the accompanying drawings, in which.

DETAILED DESCRIPTION OF THE DRAWINGS

Figure 1:
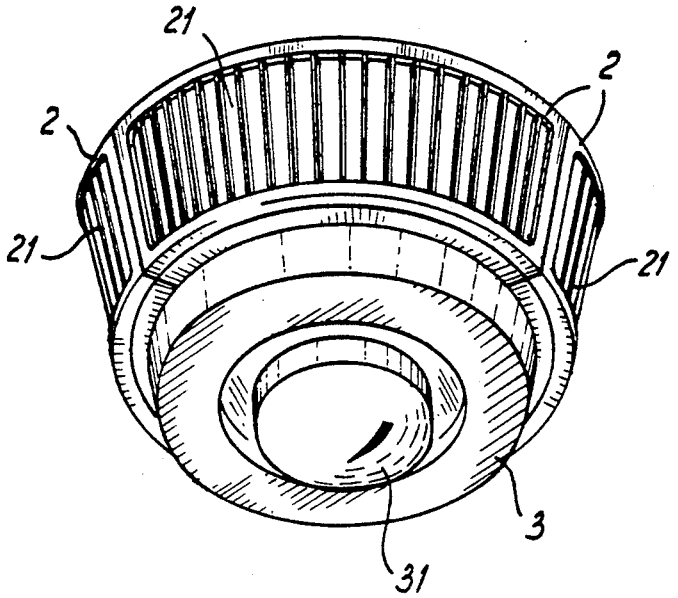
FIG. 1 shows a perspective view of a preferred embodiment of the detection unit according to the invention, provided with a further module.

The detection unit according to the invention shown in perspective in FIG. 1 comprises a support element (not shown), to which three modules 2 are attached. Each module 2 comprises a window 21, behind which a detector (not shown) is placed. The window 21 is preferably provided with means for focusing infrared radiation onto the detector. For this purpose the window 21 may, for example, be provided with Fresnel lenses.

Figure 3:
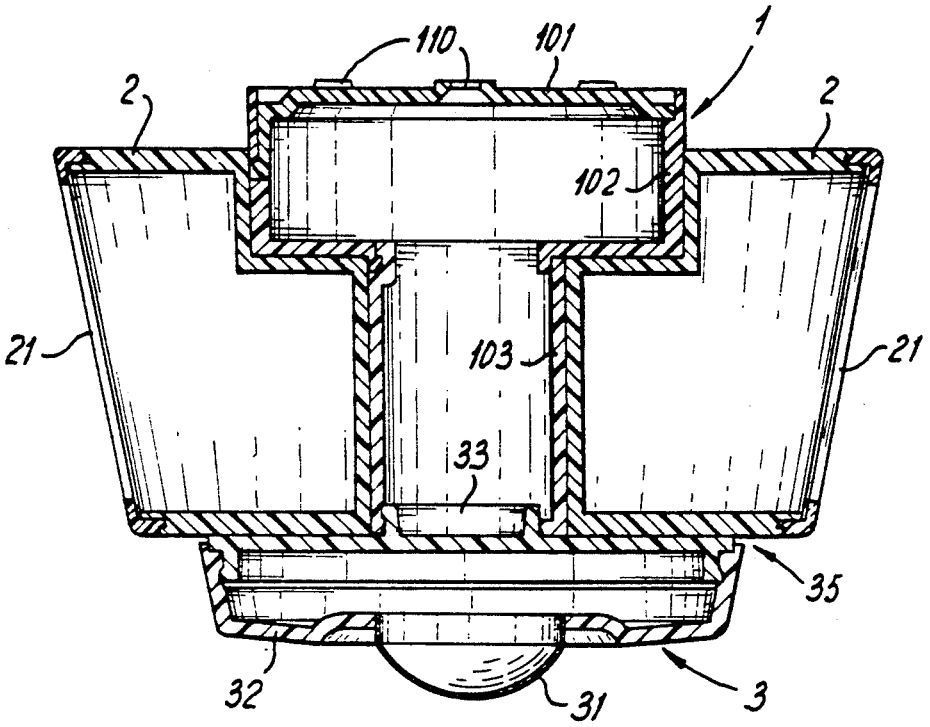
FIG. 3 shows a cross-sectional view of one embodiment of the detection unit according to the invention.
Figure 4:
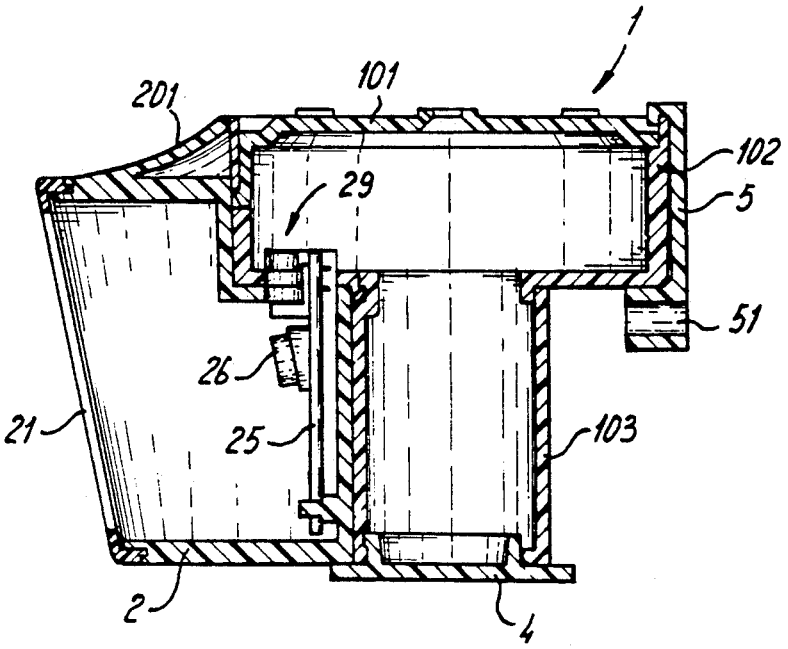
FIG. 4 shows a view in cross-section of another embodiment of the detection unit according to the invention.
Figure 6A:
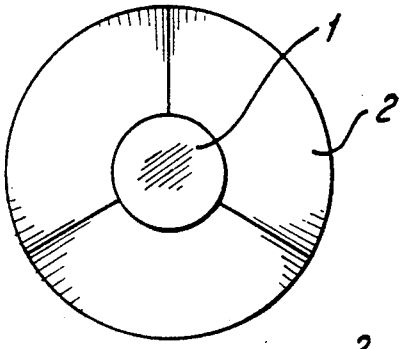
FIGS. 6*a*, 6*b*, 6*c*, 6*d*, 6*e* and 6*f* show schematically, in bottom view, possible configurations of the detection unit according to the invention.

The preferred embodiment of the detection unit may comprise one, two or three modules 2, as desired. In the embodiment shown in FIG. 1, a module 2 occupies one third of the circumference of a cylindric support element 1 as shown in FIGS. 3 and 4 so that a maximum of three modules 2 can be fitted on the support element 1. The modules 2 have the shape of a circle sector, each module 2 occupying up to one third of the circle, that is to say 120°, as is also illustrated in FIG. 6*a*. The preferred embodiment of the detection unit according to the invention shown in FIG. 1 is provided with a further module 3. The further module 3 has a window 31 and a detector (not shown) mounted behind the window 31. The further module 3 can be connected, both electrically and mechanically, to the support element 1 by means of contact pins (not shown) or suitable connectors (not shown). The window 31, which may be provided with focusing means, is constructed so that infrared radiation originating from below the detection unit falls on the detector (not shown) installed in the unit 3. The detection range of the additional module 3 may thus have the form of a cone with a top angle of e.g. 90°.

Figure 2A:
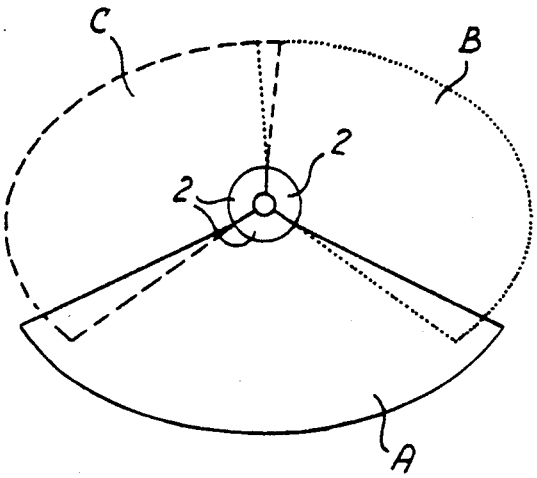
FIGS. 2*a* and 2*b* show, diagrammatically, the detection range of a detection unit according to the invention.

FIG. 2*a* shows schematically the detection range of a detection unit with three modules 2, with the detection range of each module 2 respectively being shown as A, B and C. Preferably each module 2 is constructed in such a way that the limits of the detection range of the module enclose an angle of 140°. Thus the detection ranges of adjacent modules will overlap to some extent. As can be seen from FIG. 2*a*, the detection unit according to the invention with one module 2 has a maximum detection angle of approximately 140°, a detection unit with two modules 2 a maximum detection angle of approximately 270° and a detection unit with three modules 2 a maximum detection angle of 360°. Thus a detection unit with one module 2 is suitable for placement in a corner of a space, while a detection unit with two modules 2 may for example be placed on an external corner.

Figure 2B:
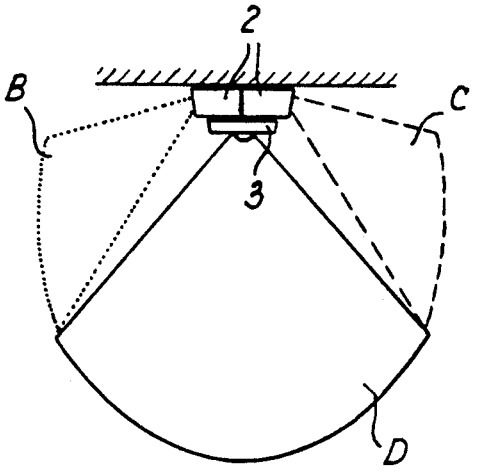

As shown in FIG. 2*b* the detection range of each module 2 extends roughly in front of the module. This is indicated by the detection ranges B and C. Since the modules 2 lie in one plane, the area directly below the detection unit is not or not sufficiently covered by the modules 2. According to a preferred embodiment of the invention, shown in FIG. 2*b*, the detection unit is therefore provided with an additional module 3, which is fitted such that it has a detection range D situated below the detection unit.

FIG. 3 shows in cross-section a preferred embodiment of the detection unit according to the present invention, in which a number of modules 2 are mounted on a support element 1. Underneath the modules 2 and the support element 1 a further or additional module 3 is mounted. The support element 1 consists of a top part 101, a middle part 102 and a longitudinal bottom part 103. The parts 101, 102 and 103 are mutually connected by suitable snap connections, each consisting of a protrusion and a cavity, thus making it possible to easily assemble or disassemble the support element 1. Of course it is also possible to use screws to connect the various parts of the support element 1, or to make it out of fewer parts.

As can clearly be seen from FIG. 3, the modules 2, of which the electrical parts, such as the detectors have not been shown for the sake of clarity, each have a window 21 which is slanted or tilted relative to the longitudinal axis of the support element 1. This construction allows an improved detection range of the modules 2, especially when the support element 1 is fixed to a ceiling. For the latter purpose, the top part 101 of the support element 1 is provided with suitable screw holes 110. The support element 1 may be cylindrical, rectangular or otherwise.

The additional or bottom module 3 is in the embodiment shown, also connected to the support element 1 by means of suitable snap connections. In the embodiment shown, the additional module 3 consists of a support part 33 and a cover part 32. The window 31 is fitted in the cover part 32. The part 33 is provided with suitable through holes (not shown) for accommodating wiring and/or electrical connectors (not shown).

As can be seen from FIG. 3, the whole unit can easily be disassembled by e.g. inserting a screw-driver into one of the slots 35 between the further module 3 and a module 2.

In FIG. 4, a further embodiment of the detection unit of the present invention is shown in cross-section, in which one module 2 has been fitted and in which the bottom or additional module 3 has been replaced by a cap 4. An additional mounting element 5 is provided to mount the detection unit to a wall. For this purpose, the mounting element 5 is provided with a suitable through hole 51. The cap 4 and the mounting element 5 can both be snapped onto the support element 1.

As can be seen from FIG. 4, the module 2 is provided with a flange 201 which closes off the middle part 102 of the support element 1. The detector 26 of the module 2 is mounted on a suitable support 25. A connector assembly 29 provides the electrical connections between the module 2 and the support element 1. Inside the support element 1, e.g. in the part 103, the circuitry of the detection unit can conveniently be arranged. This makes it possible to concentrate the intelligence of the unit in the support element, thus allowing relatively simple and inexpensive modules 2, i.e. modules 2 without electronics, to be used.

Figure 5:
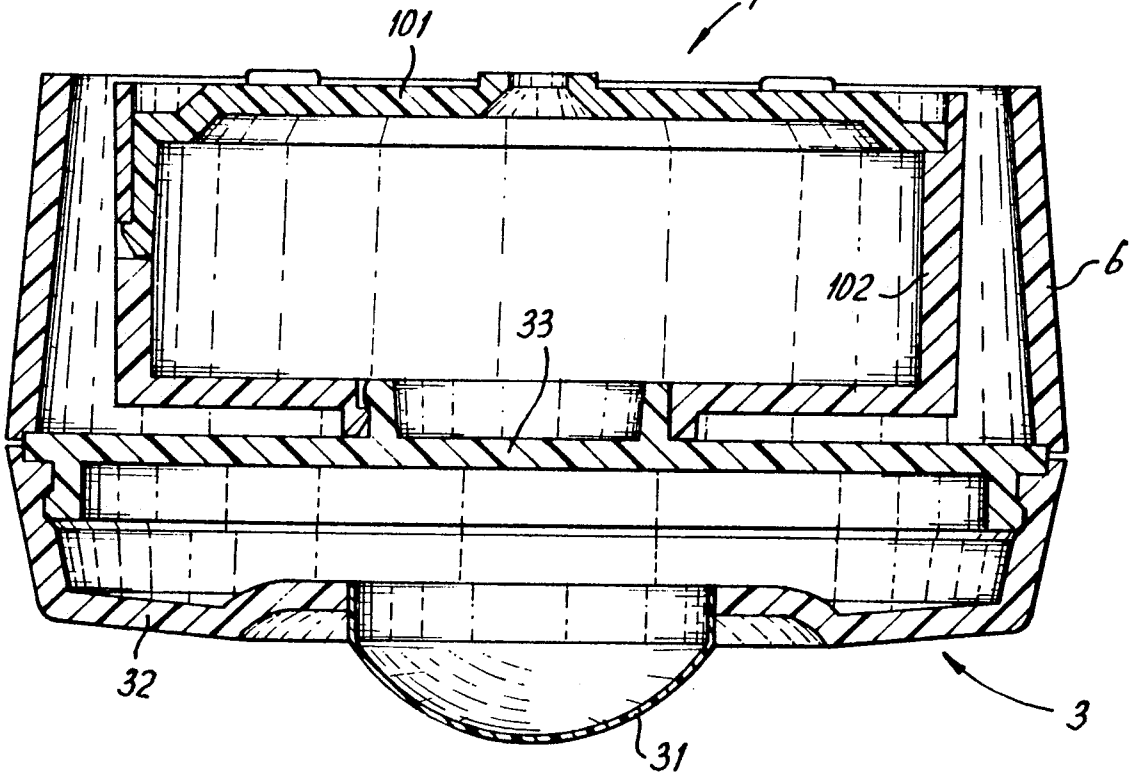
FIG. 5 shows a view in cross-section of still another embodiment of the detection unit according to the invention.

In the embodiment of FIG. 5, the modules 2 have been omitted. Thus only a further or bottom module 3 has been installed. Such a detection unit is particularly useful for spaces with relatively high ceilings. Advantageously, the part 103 of the support element 1 has been omitted as well, thus allowing a direct fixing of the part 33 of the module 3 to the part 102 of the support element 1 by suitable snap connections. In order to both provide a visually attractive unit and to close off the unit from dust, a ring 6 has been installed.

As has been shown in the FIGS. 3, 4 and 5, the modular structure of the detection unit according to the invention provides an easy adaptation of the unit to various needs and circumstances. The position of each module 2 or 3 relative to the support element 1 is fixed in each configuration, thus allowing the various module fitting positions to be allocated to well-defined detection ranges.

FIG. 6 shows schematically various possible embodiments of a detection unit according to the invention. FIG. 6*a* shows the preferred embodiment of the detection unit according to the invention, the three modules 2 being arranged around a round support element 1. Because the modules 2 have the shape of circle sectors, the circumference of the detection unit is also round. One advantage of this embodiment is that a detection range of 360° can be achieved with a relatively small number of modules, whilst the circular circumference provides maximum internal dimensions at the same time as minimal external dimensions.

Figure 6B:
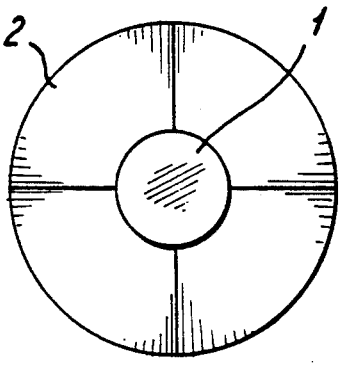
Figure 6C:
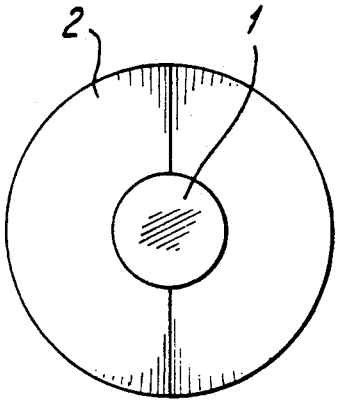

FIG. 6*b* shows an embodiment of the detection unit that is also round, with four modules 2. This embodiment is expedient if a space to be protected is to be divided into more than three sectors, a separate detection per sector being desirable. FIG. 6*c* shows a round detection unit according to the invention with two modules 2. While this embodiment may be very useful for some applications, it is not possible to achieve a detection range of 360° without mirrors or complementary detectors (two or more per module).

Figure 6D:
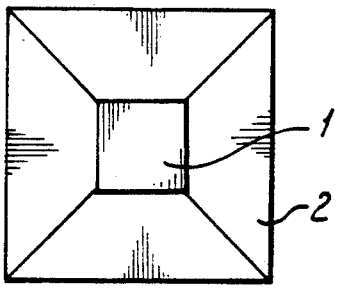
Figure 6E:
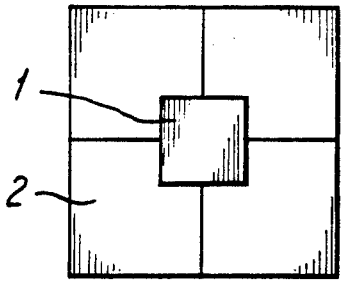
Figure 6F:
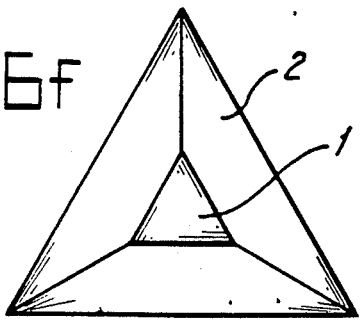

FIGS. 6*d* and 6*e* show detection units with a square circumference, each with four modules 2 and a square support element 1. Finally, FIG. 6*f* shows a triangular detection unit with three modules 2 and a triangular support element 1. In comparison with a preferred embodiment shown in FIG. 6*a* this embodiment has relatively large external dimensions. However, the advantages of the detection unit according to the invention, such as the modular construction and the achievement of a detection range of 360° with a minimum number of modules, are maintained.

In FIG. 7, an embodiment of the detection unit according to the invention is shown, in which the module 2 has a window 21 which is parallel with the longitudinal axis of the support element 1, and in which the detector 26 is movably arranged in the module 2. The module 2 is provided with contact pins 22 to achieve both an electrical and a mechanical connection with the support element 2. To receive the contact pins 22 which project from a slot 23, the support element 1 is provided with contact openings 11. Preferably the detection unit is constructed in such a way that the modules 2 are detachably connected to the support element 1. Via the contact pins 22 the electrical and the mechanical connection are achieved by plugging in the modules 2.

The support element 1, which in the embodiment shown in FIG. 7 is of cylindrical construction, but may also be rectangular, is provided at one end with a mounting element 12 for attaching the detection unit to a ceiling, wall or other support surface. In the embodiment shown, the mounting element is constructed as a round plate. Preferably the mounting element 12 is connected rotatably to the support element 1, with the result that the modules 2 with the detector fitted therein can easily be turned in the desired direction. The other end of the support element 1 is preferably provided with a turnable adjusting knob 13 with an edge 14 which, in assembled state, slots into the groove 24 of the modules 2. The function of the adjusting knob 13 will be discussed below. It is possible to construct the detection unit nonadjustable, in which case the adjusting knob 13 may, for example, be replaced by a cover plate and the slot 23 and possibly the groove 24 may be dispensed with.

Figure 7A:
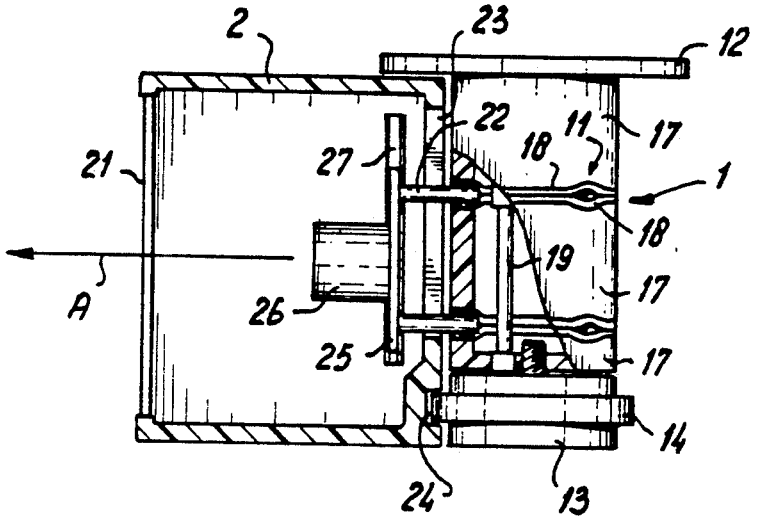
FIGS. 7*a* and 7*b* show in partial cross-section yet another embodiment of the detection unit according to the present invention.
Figure 7B:
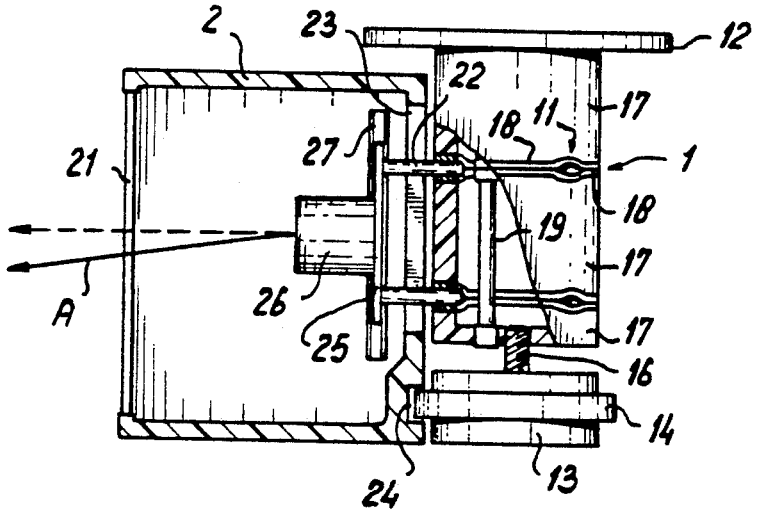
Figure 8A:
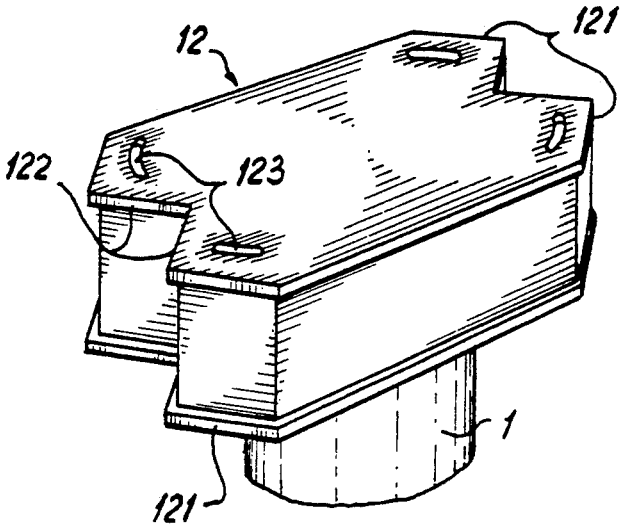
FIGS. 8*a* and 8*b* show a mounting element for use in connection with a detection unit according to the invention.
Figure 8B:
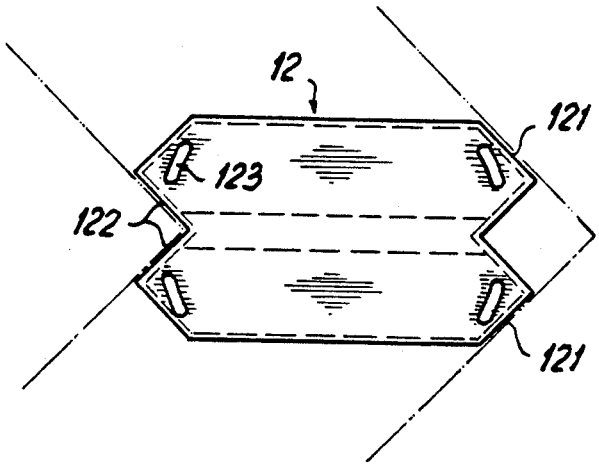

FIGS. 7*a* and 7*b* further show in partial cross section the mechanism by means of which the detectors fitted in modules 2 and thus the detection range of each module 2 can be adjusted. The adjusting knob 13 is connected to the support element 1 by means of a screw thread connection 16. Thus turning of the adjusting knob 13 will cause this adjusting knob 13 to move in the direction of the support element 1 or away from it. As the edge 14 in the assembled state slots into groove 24, rotation of the adjusting knob 13 will make module 2 shown in FIG. 7*a* move away from the mounting plate 12. As the contact pins 22 are held in the contact openings 11 of the support element 1, the contact pins 22 will not take part in this movement. Contact pins 22 will therefore move within the slot 23 relative to the module 2. The contact pins 22 are fastened to a platelet 25, to which a detector 26 and possibly electronic components (not shown) are fitted. The platelet 25 can slide within a guide 27 attached to the module 2. Movement of the module 2 relative to the support element will therefore have the effect that the position of the detector 26 changes relative to the window 21 and the (Fresnel) lenses or other optical means present therein. Therefore the optical axis A of the optical system consisting of the detector 26 and the window 21 will rotate, for example from the horizontal to somewhat downwards if the mounting element 12 is for example attached to a ceiling. Thus the detection range of module 2 will also rotate parallel with the longitudinal axis of the support element 1, and can be directed at a suitable area. Still, the detection range of each module in the plane normal to the said longitudinal axis is well-defined.

The further preferred embodiment of the support element 1 shown in FIGS. *7a* and *7b* is, in contrast to FIG. 1, constructed from three ring-shaped elements 17. Between the elements 17, pairs of metal rings 18, for example made of brass are fitted, which are shaped such that they form contact openings 11 in three places along their circumference. The contact openings 11 in this context are dimensioned so that they can detachably hold the contact pins 22. Cross connections (not shown) present within the rings 18 are each provided with a passage for fitting screwable metal sockets 19 which connect the rings 18 both mechanically and electrically. This embodiment has the advantage that the support element can be produced using a small number of relatively simple components. However, it is also possible to construct the support element 1 with the housing consisting of one piece and in which the required terminals and support elements are fitted, or as is illustrated in FIGS. 3, 4 and 5.

FIG. *8a* shows a preferred embodiment of a mounting element 12 in perspective. Mounting element 12 is herein provided with first alignment edges 121 converging relative to the center of the mounting element 12 for alignment in an internal corner with second alignment edges 122 diverging relative to the center of the mounting element 12 for alignment with regard to an external corner. In the embodiment shown, all alignment edges are fitted at an angle of 45° relative to the longitudinal direction of the mounting element 12. For the passage of, for example screws, slots 123 are provided. It goes without saying that this embodiment of the mounting element 12 is attached rigidly, that is to say nonrotatably, to the support element 1.

As shown in FIG. *8b*, the mounting element 12 can be placed in an internal corner as well as on an external corner of, for example, two walls, the converging alignment edges 121 or the diverging alignment edges 122, respectively, ensuring a placement at 45° relative to the respective corner. In the case of the detection unit according to the invention it is thus insured that the detection range does not, or only to as small an extent as possible, cover walls and that it is thus optimally placed within the space to be protected.

It will be understood that various changes and modifications in the illustrated embodiments can be made without departing from the spirit of the present invention.

I claim:

1. A detection unit comprising: a support element; means for fixing said support element on a wall or ceiling of a space to be monitored; a preselected number of detector modules, each module including a housing and at least one infrared detector fitted therein; means for releasably connecting a plurality of such detector modules to said support element in a plane parallel to and around said support element; wherein said connected modules circumferentially enclose said support element and each connected module has a defined position and detection field relative to said support element and wherein a detection field pattern desired for the space to be monitored is achieved by said preselected number of detector modules.

2. A detection unit according to claim 1 including three modules releasably connected to said support element.

3. A detection unit according to claim 1, wherein said modules essentially have the shape of circle sectors.

4. A detection unit according to claim 3, wherein said support element has a cylindrical shape.

5. A detection unit according to claim 1, wherein each module is provided with a window which is slanted relative to the longitudinal axis of said support element.

6. A detection unit according to claim 1, including a further module comprising a housing and at least one detector, said further module having a detection range which extends substantially in the axial direction of said support element.

7. A detection unit according to claim 6, wherein said further module is essentially disc-shaped.

8. A detection unit according to claim 1, wherein said detectors are connected by pins projecting into said support element which are movable relative to said module housing, and including means for shifting said modules relative to said support element in the axial direction thereof by means of an adjustment element fitted on said support element and engaging said modules in such a way that the position of said detectors is adjusted by movement of said adjustment element.

9. A detection unit according to claim 1, including a mounting element for mounting said support element on a supporting surface.

10. A detection unit according to claim 9, including terminals for accepting contact pins of said modules.

11. A detection unit according to claim 9, wherein said mounting element is rotatably connected to said support element.

12. A detection unit according to claim 9, wherein said mounting element is provided with at least two diverging edges for placement in a corner.

13. A detection unit according to claim 9, wherein said mounting element is provided with at least two converging edges for placement in a corner.

14. A detection unit according to claim 1, including a focusing means for focusing infrared radiation onto each infrared detector.

* * * * *